US008608445B2

(12) United States Patent
Burgess et al.

(10) Patent No.: US 8,608,445 B2
(45) Date of Patent: Dec. 17, 2013

(54) CENTRIFUGAL PUMP IMPELLERS

(75) Inventors: Kevin Edward Burgess, Carlingford (AU); Wen-Jie Liu, Eastwood (AU); Luis Moscoso Lavagna, North Ryde (AU)

(73) Assignee: Weir Minerals Australia, Ltd. (AU)

( * ) Notice: Subject to any disclaimer, the term of this patent is extended or adjusted under 35 U.S.C. 154(b) by 381 days.

(21) Appl. No.: 12/736,934

(22) PCT Filed: May 27, 2009

(86) PCT No.: PCT/AU2009/000662

§ 371 (c)(1),
(2), (4) Date: Feb. 16, 2011

(87) PCT Pub. No.: WO2009/143570

PCT Pub. Date: Dec. 3, 2009

(65) Prior Publication Data

US 2011/0158795 A1 Jun. 30, 2011

(30) Foreign Application Priority Data

May 27, 2008 (AU) ..... 2008902665
Mar. 16, 2009 (AU) ..... 2009901137

(51) Int. Cl.
*F04D 29/22* (2006.01)

(52) U.S. Cl.
USPC ..... 416/186 R; 416/DIG. 2

(58) Field of Classification Search
USPC ..... 415/204, 206; 416/179, 182, 185, 416/186 R, DIG. 2
See application file for complete search history.

(56) References Cited

U.S. PATENT DOCUMENTS

| | | | | |
|---|---|---|---|---|
| 3,167,021 | A | 1/1965 | Sence | |
| 3,238,534 | A * | 3/1966 | Hartland | 415/116 |
| 3,285,187 | A | 11/1966 | Anderson, Jr. | |
| 3,837,627 | A | 9/1974 | Sence et al. | |
| 3,881,840 | A | 5/1975 | Bunjes | |
| 3,953,150 | A | 4/1976 | Onal | |
| 3,986,791 | A | 10/1976 | Paciga et al. | |
| 4,533,294 | A * | 8/1985 | Onal | 415/119 |
| 4,872,809 | A | 10/1989 | Addie et al. | |
| 4,883,403 | A | 11/1989 | Walker | |
| 5,171,126 | A * | 12/1992 | Becker et al. | 415/121.2 |
| 5,192,142 | A | 3/1993 | Hyll | |

(Continued)

FOREIGN PATENT DOCUMENTS

GB 2092228 A 8/1982

*Primary Examiner* — Nathaniel Wiehe
*Assistant Examiner* — Joshua R Beebe
(74) *Attorney, Agent, or Firm* — Morriss O'Bryant Compagni

(57) ABSTRACT

A centrifugal pump impeller includes front and back shrouds and a plurality of pumping vanes therebetween, each pumping vane having a leading edge in the region of an impeller inlet and a trailing edge, the front shroud has an arcuate inner face in the region of the impeller inlet, the arcuate inner face having a radius of curvature ($R_s$) in the range from 0.05 to 0.16 of the outer diameter of the impeller ($D_2$) The back shroud includes an inner main face and a nose having a curved profile with a nose apex in the region of the central axis which extends towards the front shroud, there being a curved transition region between the inner main face and the nose. $F_r$ is the radius of curvature of the transition region and the ratio $F_r/D_2$ is from 0.32 to 0.65. Other ratios of various dimensions of the impeller are also described.

24 Claims, 10 Drawing Sheets

(56) References Cited

U.S. PATENT DOCUMENTS

| | | | | |
|---|---|---|---|---|
| 5,192,193 | A | 3/1993 | Cooper et al. | |
| 5,368,443 | A | 11/1994 | Turkia et al. | |
| 5,411,367 | A * | 5/1995 | Walker | 415/170.1 |
| 5,605,444 | A * | 2/1997 | Paton et al. | 416/183 |
| 5,609,468 | A | 3/1997 | Burgess | |
| 5,797,724 | A * | 8/1998 | Liu et al. | 415/206 |
| 5,873,697 | A | 2/1999 | Gully | |
| 7,326,029 | B2 | 2/2008 | Ahlroth et al. | |
| 2002/0106277 | A1 * | 8/2002 | Chapman | 415/206 |
| 2010/0239417 | A1 | 9/2010 | Scott | |

* cited by examiner

CENTRIFUGAL PUMP IMPELLERS

BACKGROUND OF THE INVENTION

1. Technical Field

This disclosure relates generally to centrifugal pumps and more particularly though not exclusively to pumps for handling abrasive materials such as for example slurries and the like.

2. Background Art

Centrifugal slurry pumps, which may typically comprise hard metal or elastomer liners and/or casings that resist wear, are widely used in the mining industry. Normally, the higher the slurry density, or the larger or harder the slurry particles, will result in higher wear rates and reduced pump life.

Centrifugal slurry pumps are widely used in minerals processing plants from the start of the process where the slurry is very coarse with associated high wear rates (for example, during milling), to the end of the process where the slurry is very much finer and the wear rates greatly reduced (for example, when flotation tailings are produced). As an example, slurry pumps dealing with a coarser particulate feed duty may only have a life of wear parts measured in weeks or months, compared to pumps at the end of the process which have wear parts which can last from one to two years in operation.

The wear in centrifugal slurry pumps that are used for handling coarse particulate slurries typically is worst at the impeller inlet, because the solids have to turn through a right angle (from axial flow in the inlet pipe to radial flow in the pump impeller) and, in so doing, the particle inertia and size results in more impacts and sliding motion against the impeller walls and the leading edge of the impeller vanes.

The impeller wear occurs mainly on the vanes and the front and rear shrouds at the impeller inlet. High wear in these regions can also influence the wear on the front liner of the pump. The small gap that exists between the rotating impeller and the stationary front liner (sometimes referred to as the throatbush) will also have an effect on the life and performance of the pump wear parts. This gap is normally quite small, but typically increases due to wear on the impeller front, impeller shroud or due to wear on both the impeller and the front liner.

One way to reduce the flow that escapes from the high pressure casing region of the pump (through the gap between the front of the impeller and the front liner into the pump inlet) is by incorporating a raised and angled lip on the stationary front liner at the impeller inlet. The impeller has a profile to match this lip. While the flow through the gap can be reduced by the use of expelling vanes on the front of the impeller, the flow through the gap can also effectively minimised by designing and maintaining this narrow gap.

Some, but not all, pumps can have means to maintain the gap between the impeller and the front liner as small as practicable without causing excess wear by rubbing. A small gap normally improves the front liner life but the wear at the impeller inlet still occurs and is not diminished.

The high wear at the impeller entry relates to the degree of turbulence in the flow as it changes from axial to radial direction. The geometry of a poorly designed impeller and pumping vanes can dramatically increase the amount of turbulence and hence wear.

The various aspects disclosed herein may be applicable to all centrifugal slurry pumps and particularly to those that experience high wear rates at the impeller inlet or to those that are used in applications with high slurry temperatures.

SUMMARY OF THE DISCLOSURE

In a first aspect, embodiments are disclosed of an impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis, the impeller including a front shroud, a back shroud and a plurality of pumping vanes therebetween, each pumping vane having a leading edge in the region of an impeller inlet and a trailing edge, wherein the front shroud has an arcuate inner face in the region of the impeller inlet, the arcuate inner face having a radius of curvature ($R_S$) in the range from 0.05 to 0.16 of the outer diameter of the impeller ($D_2$), said back shroud including an inner main face and a nose having a curved profile with a nose apex in the region of the central axis which extends towards the front shroud, there being a curved transition region between the inner main face and the nose, wherein $F_r$ is the radius of curvature of the transition region, the ratio $F_r/D_2$ being from 0.32 to 0.65.

In a second aspect, embodiments are disclosed of an impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis the impeller including a front shroud, a back shroud and a plurality of pumping vanes therebetween, each pumping vane having a leading edge in the region of an impeller inlet and a trailing edge, wherein the front shroud has an arcuate inner face in the region of the impeller inlet, the arcuate inner face having a radius of curvature ($R_S$) in the range from 0.05 to 0.16 of the outer diameter of the impeller ($D_2$), said back shroud having an inner main face and a nose having a curved profile with a nose apex in the region of the central axis which extends towards the front shroud, there being a curved transition region between the inner main face and the nose, wherein Inr is the radius of curvature of the curved profile of the nose, the ratio $I_{nr}/D_2$ being from 0.17 to 0.22.

In a third aspect, embodiments are disclosed of an impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis the impeller including a front shroud, a back shroud and a plurality of pumping vanes therebetween with passageways between adjacent pumping vanes, each pumping vane having a leading edge in the region of an impeller inlet and a trailing edge, wherein the front shroud has an arcuate inner face in the region of the impeller inlet, the inner face having a radius of curvature ($R_S$) in the range from 0.05 to 0.16 of the outer diameter of the impeller ($D_2$) and wherein one or more of the passageways have one or more discharge guide vanes associated therewith the or each discharge guide vane being located at a main face of at least one of the shrouds.

In a fourth aspect, embodiments are disclosed of an impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis, the impeller including a front shroud, a back shroud and a plurality of pumping vanes therebetween, each pumping vane having a leading edge in the region of an impeller inlet and a trailing edge with a main portion therebetween, wherein each pumping vane has a vane leading edge having a radius $R_v$ in the range from 0.18 to 0.19 of the main portion of the pumping vane thickness $T_v$.

In a fifth aspect, embodiments are disclosed of an impeller which includes: a front shroud and a back shroud, the back shroud including a back face and an inner main face with an outer peripheral edge and a central axis, a plurality of pumping vanes projecting from the inner main face of the back shroud to the front shroud, the pumping vanes being disposed in spaced apart relation on the inner main face providing a discharge passageway between adjacent pumping vanes, each pumping vane including a leading edge portion in the region of the central axis and a trailing edge portion in the region of the peripheral edge, the back shroud further including a nose having a curved profile with a nose apex in the region of the central axis which extends towards the front shroud, there being a curved transition region between the inner main face and the nose, wherein $I_{nr}$ is the radius of curvature of the curved profile of the nose and $D_2$ is the diameter of the impeller, the ratio $I_{nr}/D_2$ being from 0.02 to 0.50, wherein one or more of the passageways have associated therewith one or more discharge guide vanes the or each discharge guide vanes being located at a main face of at least one of the shrouds.

In a sixth aspect, embodiments are disclosed of an impeller which includes: a front shroud and a back shroud, the back shroud including a back face and an inner main face with an outer peripheral edge and a central axis, a plurality of pumping vanes projecting from the inner main face of the back shroud to the front shroud, the pumping vanes being disposed in spaced apart relation on the inner main face providing a discharge passageway between adjacent pumping vanes, each pumping vane including a leading edge portion in the region of the central axis and a trailing edge portion in the region of the peripheral edge, the back shroud further including a nose having a curved profile with a nose apex in the region of the central axis which extends towards the front shroud, there being a curved transition region between the inner main face and the nose, wherein $I_{nose}$ is the distance from a plane containing the inner main face of the back shroud to the nose apex, at right angles to the central axis and $B_2$ is the pumping vane width, and the ratio $I_{nose}/B_2$ being from 0.25 to 0.75, wherein one or more of the passageways have associated therewith one or more discharge guide vanes the or each discharge guide vanes being located at a main face of at least one of the shrouds.

In a seventh aspect, embodiments are disclosed of an impeller which includes: a front shroud and a back shroud, the back shroud including a back face and an inner main face with an outer peripheral edge and a central axis, a plurality of pumping vanes projecting from the inner main face of the back shroud to the front shroud, the pumping vanes being disposed in spaced apart relation on the inner main face providing a discharge passageway between adjacent pumping vanes, each pumping vane including a leading edge portion in the region of the central axis and a trailing edge portion in the region of the peripheral edge, the back shroud further including a nose having a curved profile with a nose apex in the region of the central axis which extends towards the front shroud, there being a curved transition region between the inner main face and the nose, wherein $F_r$ is the radius of curvature of the transition region and $D_2$ is the diameter of the impeller, and the ratio $F_r/D_2$ being from 0.20 to 0.75, wherein one or more of the passageways have associated therewith one or more discharge guide vanes the or each discharge guide vanes being located at a main face of at least one of the shrouds.

In some embodiments the inner face can have a radius of curvature $R_s$ in the range from 0.08 to 0.15 of the outer diameter of the impeller $D_2$.

In some embodiments the inner face can have a radius of curvature $R_s$ in the range from 0.11 to 0.14 of the outer diameter of the impeller $D_2$.

In some embodiments the inner face can have a radius of curvature $R_s$ in the range from 0.12 to 0.14 of the outer diameter of the impeller $D_2$.

In some embodiments the ratio $F_r/D_2$ can be from 0.32 to 0.65.

In some embodiments the ratio $F_r/D_2$ can be from 0.41 to 0.52.

In some embodiments the ratio $I_{nr}/D_2$ can be from 0.10 to 0.33.

In some embodiments the ratio $I_{nr}/D_2$ can be from 0.17 to 0.22.

In some embodiments $I_{nose}$ is the distance from a plane containing the inner main face of the back shroud to the nose apex at right angles to the central axis, and $B_2$ is the pumping vane width, and the ratio $I_{nose}/B_2$ can be from 0.25 to 0.75.

In some embodiments the ratio $I_{nose}/B_2$ can be from 0.4 to 0.65.

In some embodiments the ratio $I_{nose}/B_2$ can be from 0.48 to 0.56.

In some embodiments the or each pumping vane can have a main portion between the leading and trailing edge portions thereon, the vane leading edge portion tapered transition length and a leading edge having a radius $R_v$ in the range from 0.09 to 0.45 of the thickness $T_v$ of a main vane portion.

In some embodiments the leading edge of the vane can be straight but preferably profiled to best control the inlet angle, which can vary between the rear and front shrouds to achieve lower turbulence and wake as the flow enters the impeller passageway. This transition region from the leading edge radius to the full vane thickness can be a linear or gradual transition from the radius on the leading edge ($R_v$) to the main portion thickness ($T_v$). In one embodiment, each vane can have a transition length $L_t$ between the leading edge and main portion thickness, the transition length being in the range from 0.5 $T_v$ to 3 $T_v$, that is, the transition length varies from 0.5 to 3 times the vane thickness.

In some embodiments the vane leading edge can have a radius $R_v$ in the range from 0.125 to 0.31 of the thickness $T_v$ of the main portion.

In some embodiments the vane leading edge can have a radius $R_v$ in the range from 0.18 to 0.19 of the thickness $T_v$ of the main portion.

In some embodiments the thickness $T_v$ of the main portion can be in the range from 0.03 to 0.11 of the outer diameter of the impeller $D_2$. In some embodiments the pumping vane thickness $T_v$ of the main portion can be in the range from 0.055 to 0.10 of the outer diameter of the impeller $D_2$.

In some embodiments each vane can have a transition length $L_t$ between the leading edge and full vane thickness, the transition length being in the range from 0.5 $T_v$ to 3 $T_v$.

In some embodiments the thickness of the main portion can be substantially constant throughout its length.

In some embodiments each pumping vane can have a vane leading edge having a radius $R_v$ in the range from 0.09 to 0.45 of the main portion thickness $T_v$.

In some embodiments the vane leading edge can have a radius $R_v$ in the range from 0.125 to 0.31 of the main portion thickness $T_v$.

In some embodiments the vane leading edge can have a radius $R_v$ in the range from 0.18 to 0.19 of the main portion thickness $T_v$.

In some embodiments the main portion thickness $T_v$ of each vane can be in the range from 0.03 to 0.11 of the outer diameter $D_2$ of the impeller.

In some embodiments the main portion thickness $T_v$ of each vane can be in the range from 0.055 to 0.10 of the outer diameter $D_2$ of the impeller.

In some embodiments each vane can have a transition length $L_t$ between the leading edge and full vane thickness, the transition length being in the range from 0.5 $T_v$ to 3 $T_v$.

In some embodiments one or more of the passageways can have one or more discharge guide vanes associated therewith, the or each discharge guide vane located at the main face of at least one of the or each shroud(s).

In some embodiments the or each discharge guide vane can be a projection from the main face of the shroud with which it is associated and which extends into a respective passageway.

In some embodiments the or each discharge guide vane can be elongate.

In some embodiments the or each discharge guide vane can have an outer end adjacent the peripheral edge of the shroud, the discharge guide vane extending inwardly and terminating at an inner end which is intermediate the central axis and the peripheral edge of the shroud with which it is associated.

In some embodiments two said shrouds are provided, and one or more of the shrouds can have a discharge guide vane projecting from a main face thereof.

In some embodiments the or each said discharge guide vane can have a height which is from 5 to 50 percent of pumping vane width.

In some embodiments the or each discharge guide vane generally can have the same shape and width of the main pumping vanes when viewed in a horizontal cross-section.

In some embodiments each discharge guide vane can be of a tapering height.

In some embodiments each discharge guide vane can be of a tapering width.

In some embodiments the pumping vane leading edge angle Ai to the impeller central axis can be from 20° to 35°.

In some embodiments the impeller inlet diameter $D_1$ can be in the range from 0.25 to 0.75 of the impeller outer diameter $D_2$.

In some embodiments the impeller inlet diameter $D_1$ can be in the range from 0.25 to 0.5 of the impeller outer diameter $D_2$.

In some embodiments the impeller inlet diameter $D_1$ can be in the range from 0.40 to 0.75 of the impeller outer diameter $D_2$.

In an eighth aspect embodiments are disclosed of, in combination, an impeller as described in any of the preceding embodiments and a front liner, the front liner having a raised lip which subtends an angle ($A_3$) to the impeller central axis in the range from 10° to 80°.

In a ninth aspect embodiments are disclosed of, in combination, an impeller as described in any of the preceding embodiments and a front liner, the front liner having an inner end and an outer end, the diameter $D_4$ of the inner end being in the range 0.55 to 1.1 of the diameter $D_3$ of the outer end.

In a tenth aspect embodiments are disclosed of, in combination, an impeller as described in any of the preceding embodiments and a front liner, defining an angle $A_2$ between the parallel faces of the impeller and front liner, and a plane normal to the rotation axis which is in the range from 0° to 20°.

In an eleventh aspect embodiments are disclosed of a method of retrofitting an impeller to a centrifugal pump, the pump including a pump casing having a chamber therein, an inlet for delivering material to be pumped to the chamber and an outlet for discharging material from the chamber, the impeller being mounted for rotation within the chamber when in use about a rotation axis the impeller being as described in any of the preceding embodiments, the method including operatively connecting the impeller to a drive shaft of a drive which extends into the chamber.

In some embodiments an impeller or an impeller and liner combination may include a combination of any two or more of the aspects of certain embodiments described above.

To minimise the turbulence in the impeller inlet region, the arrangement desirably incorporates features to minimise the cavitation characteristics on the performance of the pump. This means that the design minimises the net positive intake (or suction) head required (normally called NPSH). Cavitation occurs when the pressure available at the pump intake is lower than that required by the pump, causing the slurry water to 'boil' and vapour pockets, wakes and turbulence to be created. The vapour and turbulence will cause damage to the pump inlet vanes and shrouds by removing material and creating pinholes and small pockets of wear that can increase in size with time.

The slurry particles entering the inlet can be deflected from a smooth streamline by the vapour and turbulent flow, thereby accelerating the rate of wear. A turbulent flow creates small to large scale spiraling or vortex types of flow patterns. When the particles are trapped in these spiraling flows, their velocity is greatly increased and, as a general rule, the wear on the pump parts tends to increase. The wear rate in slurry pumps can be related to the particle velocity raised to the power of two to three, so maintaining low particle velocities is useful to minimise wear.

Some mineral processing plants (such as alumina production plants) require elevated operating temperatures to assist with the mineral extraction process. High temperature slurries require pumps that have good cavitation-damping characteristics. The lower the NPSH required by the pump, the better the pump will be able to maintain its performance. An impeller design having low cavitation characteristics will assist in both minimising wear and in minimising the effect on the pump performance, and therefore minerals processing plant output.

One of the ways to decrease turbulence in the feed slurry entering the pump is to provide a smooth change in angle for the slurry flow and its entrained particles, as the slurry moves from a horizontal to a vertical direction of flow. The inlet may be rounded by contouring the internal passageway shape of the impeller in conjunction with the front liner. The rounding produces more streamlined flow and less turbulence as a result. The inlet of the front liner can also be rounded or incorporate a smaller inlet diameter or throat which can also assist in smoothing the turning flow path of the slurry.

A further means to turn the flow more evenly is to incorporate an angled front liner and matching angled impeller front face.

Lower rates of turbulence at the impeller inlet region will result in less wear overall. Wear life is of primary importance for pumps in heavy and severe slurry applications in the minerals processing industries. As described hereinabove, to achieve lower wear at the impeller inlet requires a combination of certain dimensional ratios to produce specific low turbulence geometry. The inventors have surprisingly discovered that this preferred geometry is largely independent of the ratio of the impeller outside diameter to the inlet diameter (normally referred to as the impeller ratio).

It has been discovered that the various ratios described above or in combination provide an optimum geometry to firstly produce a smooth flow pattern and to minimise the shock losses at the entrance to the impeller passageway and secondly to control the amount of turbulence for as long as possible through the impeller passageway. The various ratios are important because these control the flow from an axial direction into the impeller through a turn of ninety degrees to form a radial flow, and also to smooth the flow past the leading edges of the main pumping vanes into each of the impeller discharge passageways (that is, the passageways between each of the main pumping vanes).

In particular, an impeller having the dimensional ratios of $R_s/D_2$ in the range from 0.05 to 0.16, and $F_r/D_2$ from 0.32 to 0.65 have been found to provide the advantageous effects described above.

In particular, an impeller having the dimensional ratios of $R_s/D_2$ in the range from 0.05 to 0.16, and $I_{nr}/D_2$ from 0.17 to 0.22 have been found to provide the advantageous effects described above.

In particular, an impeller having pumping vanes with the dimensional ratios of $R_v/T_v$ in the range from 0.18 to 0.19 have been found to provide the advantageous effects described above.

Further improvement was also achieved by the provision of discharge guide vanes, as described above. The discharge guide vanes are believed to control the turbulence due to vortices in the flow of material which is passing through the impeller passageway during use. Increased turbulence can lead to increased wear of impeller and volute surfaces as well as increased energy losses, which ultimately require an operator to input more energy into the pump to achieve a desired throughput. Depending on the selected position of the discharge guide vanes, the turbulence region immediately in front of the pumping face of the impeller pumping vanes can be substantially confined. As a result, the intensity (or strength) of the vortices is diminished because they are not allowed to grow in an unconstrained manner. A further beneficial outcome was that the smoother flow throughout the impeller passageway reduced the turbulence and thereby also reduced the wear due to particles in the slurry flow.

The improvements in performance included that the pressure generated by the pump gave less depression at higher flows (that is, less loss of energy with flow—noting that traditional impellers have a steeper characteristic loss with same number of main pumping vanes); that the efficiency increased 7 to 8% in absolute terms; that the cavitation characteristic of the pump reduced and remained flatter, right out to higher flows (conventional impellers have a steeper characteristic); and that the wear life of the impeller increased by 50% compared to a traditional design of impeller.

Under current, traditional design protocols it was always considered that one performance parameter could be increased but at the expense of another, e.g., higher, efficiency but lower wear life. The present invention has contradicted this view by achieving all round better performance for all parameters.

As a result of an all round better performance, the impeller can be manufactured using 'standard' materials, without the need for special alloys materials which would otherwise be required to solve localised high wear issues.

Experimental trials have demonstrated that these design parameters and the specification of certain dimensional ratios can produce relatively low or substantially optimum impeller wear, especially around the eye (inlet region) of the impeller.

BRIEF DESCRIPTION OF THE DRAWINGS

Notwithstanding any other forms which may fall within the scope of the apparatus, and method as set forth in the Summary, specific embodiments of the method and apparatus will now be described, by way of example, and with reference to the accompanying drawings in which.

DETAILED DESCRIPTION OF THE SPECIFIC EMBODIMENTS

Figure 1:
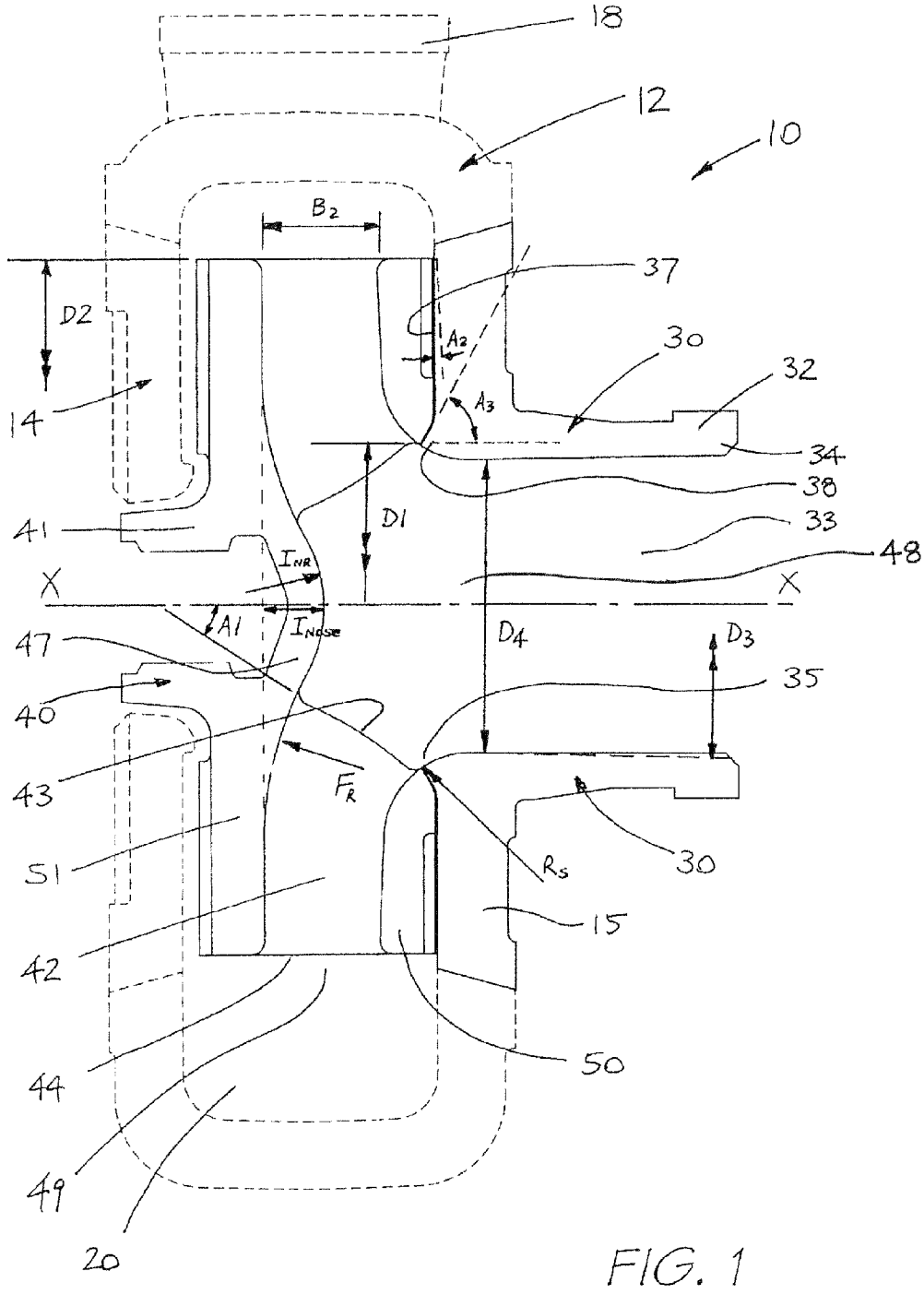
FIG. 1 illustrates an exemplary, schematic, partial cross-sectional side elevation of a pump incorporating an impeller and an impeller and liner combination, in accordance with one embodiment.

Referring to FIGS. 1 and IA there is illustrated an exemplary pump 10 in accordance with certain embodiments including a pump casing 12, a back liner 14, a front liner 30 and a pump outlet 18. An internal chamber 20 is adapted to receive an impeller 40 for rotation about rotational axis X-X.

The front liner 30 includes a cylindrically-shaped delivery section 32 through which slurry enters the pump chamber 20. The delivery section 32 has a passage 33 therein with a first, outermost end 34 operatively connectable to a feed pipe (not shown) and a second, innermost end 35 adjacent the chamber 20. The front liner 30 further includes a side wall section 15 which mates with the pump casing 12 to form and enclose the chamber 20, the side wall section 15 having an inner face 37. The second end 35 of the front liner 30 has a raised lip 38 thereat, which is arranged to mate with the impeller 40.

The impeller 40 includes a hub 41 from which a plurality of circumferentially spaced pumping vanes 42 extend. A nose or eye portion 47 extends forwardly from the hub towards the passage 33 in the front liner. The pumping vanes 42 include a leading edge 43 located at the region of the impeller inlet 48, and a trailing edge 44 located at the region of the impeller outlet 49. The impeller further includes a front shroud 50 and a back shroud 51, the vanes 42 being disposed therebetween.

Figure 2:
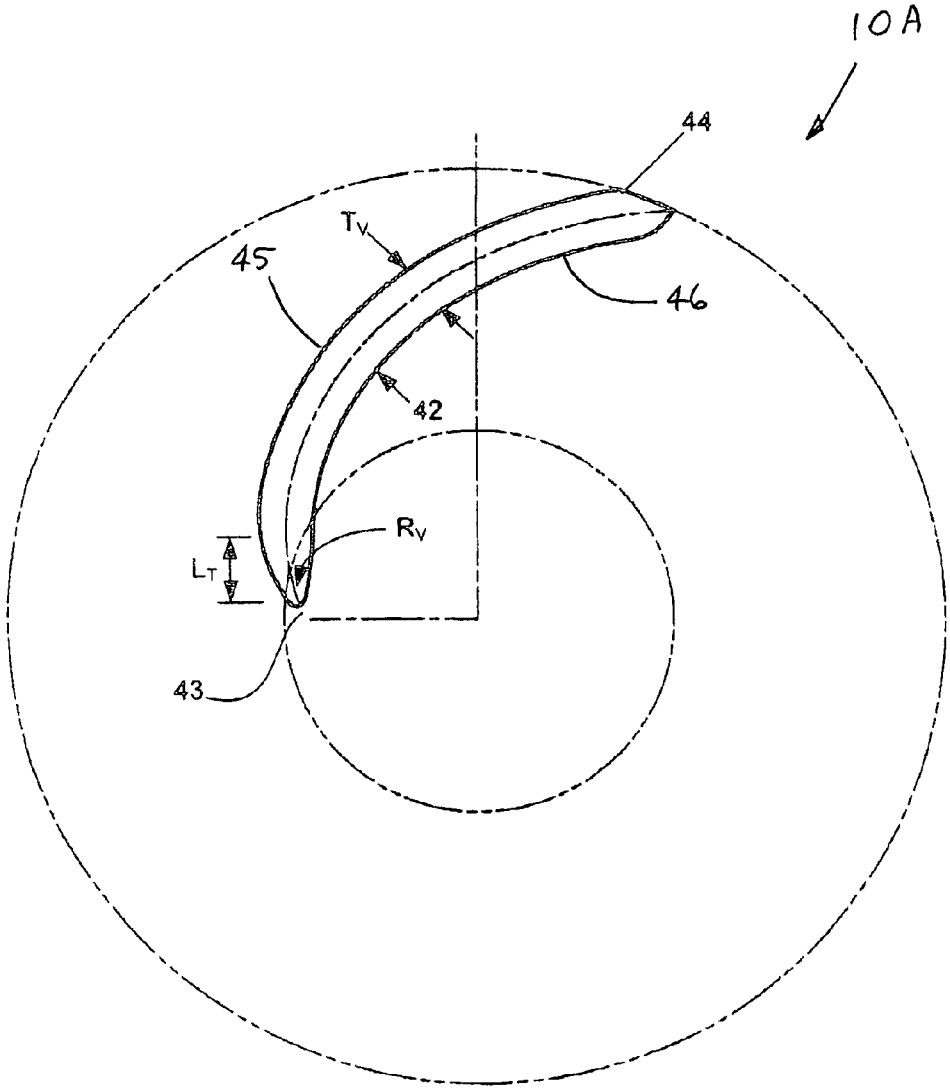
FIG. 2 illustrates an exemplary, schematic, cross-sectional top view of an impeller pumping vane in accordance with another embodiment.
Figure 3:
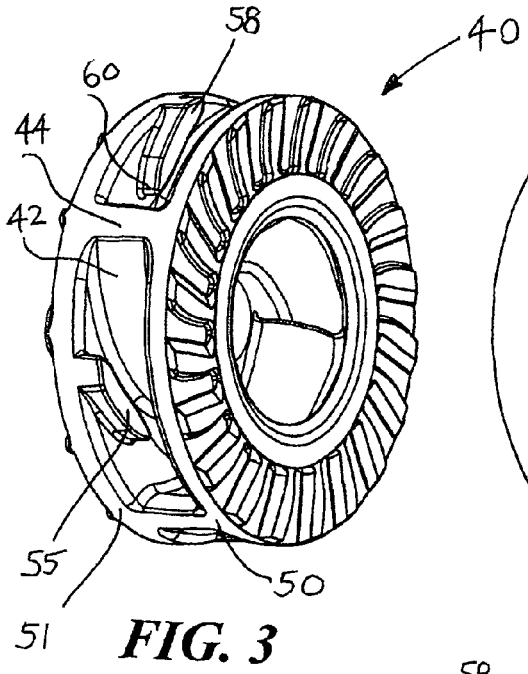
FIGS. 3 to 12 illustrate exemplary whole and partially sectional views of an impeller and of an inlet liner, with some views showing the combination of impeller and inlet liner in accordance with certain embodiments.
Figure 4:
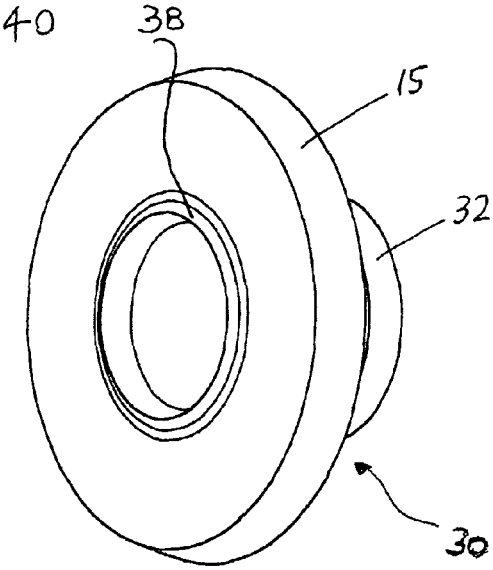
Figure 5:
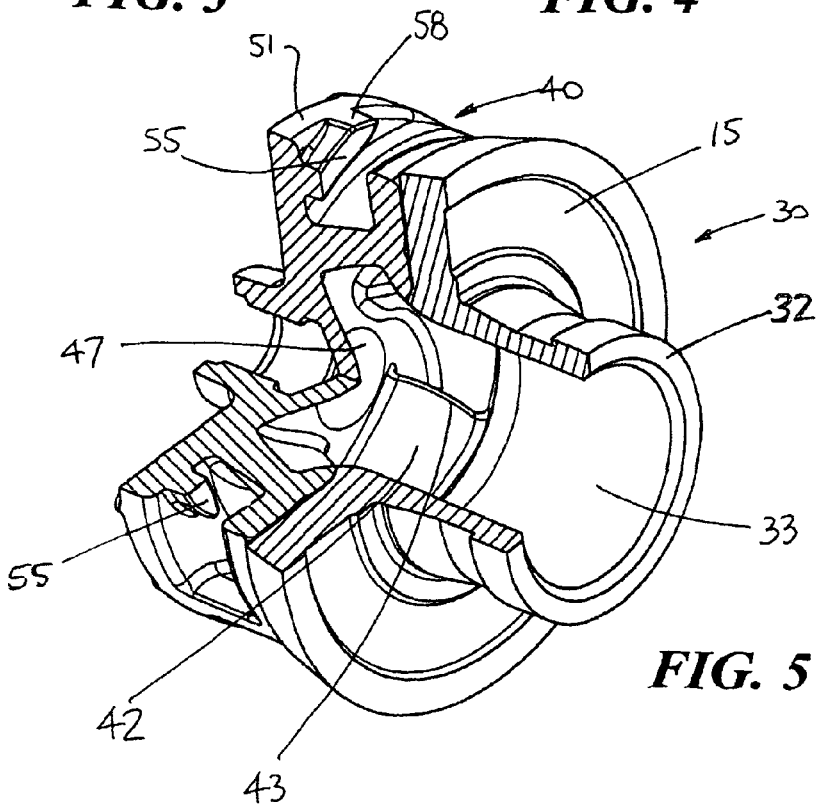
Figure 6:
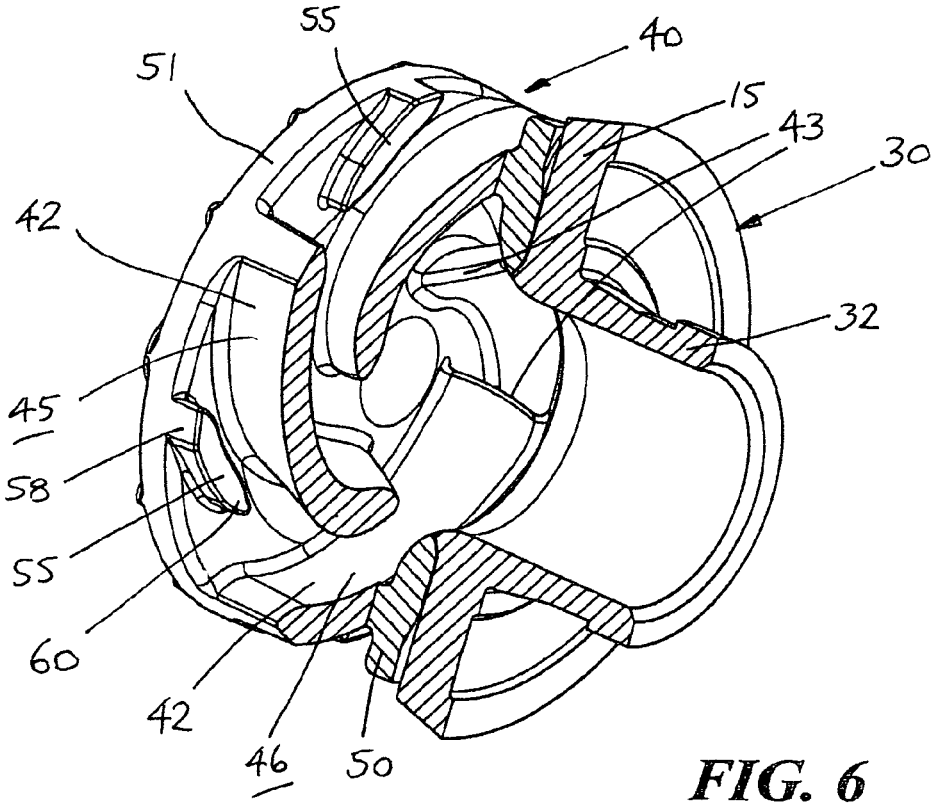
Figure 7:
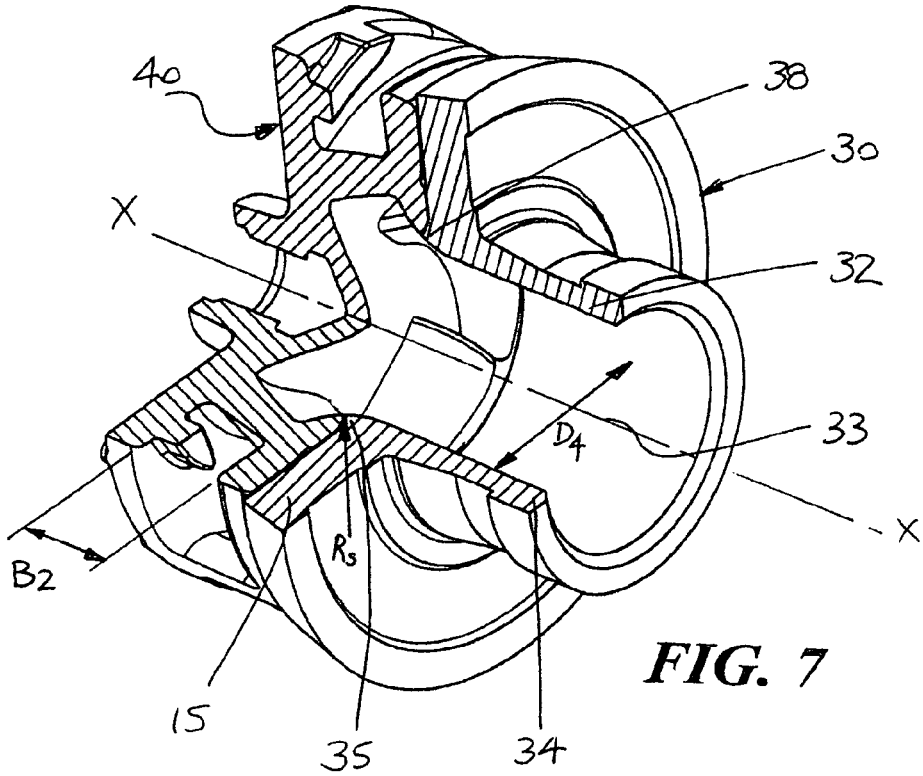
Figure 8:
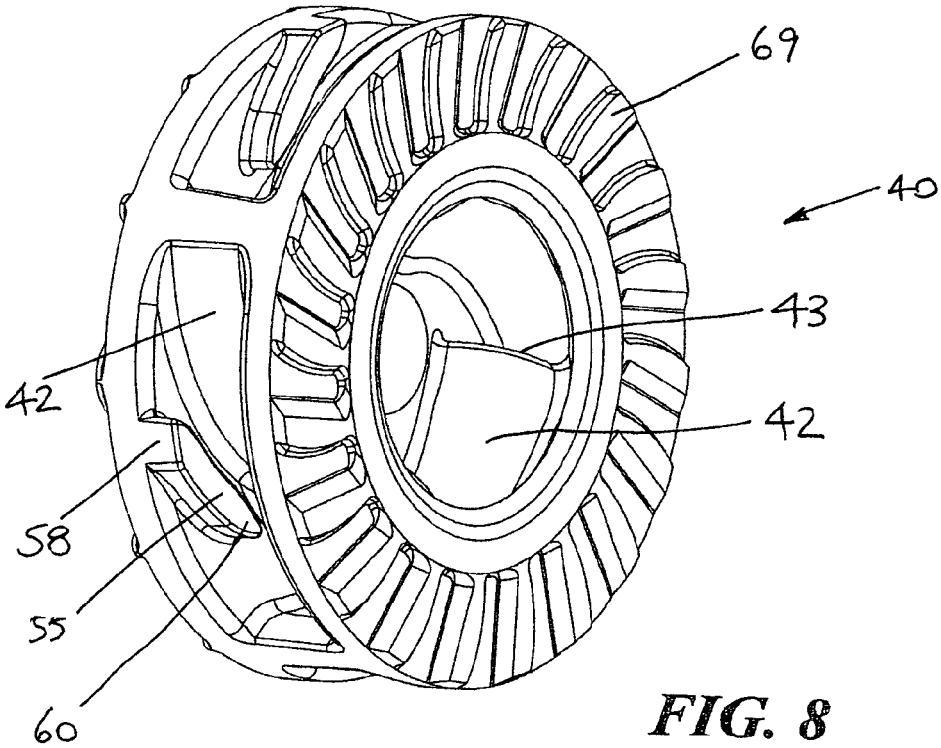
Figure 9:
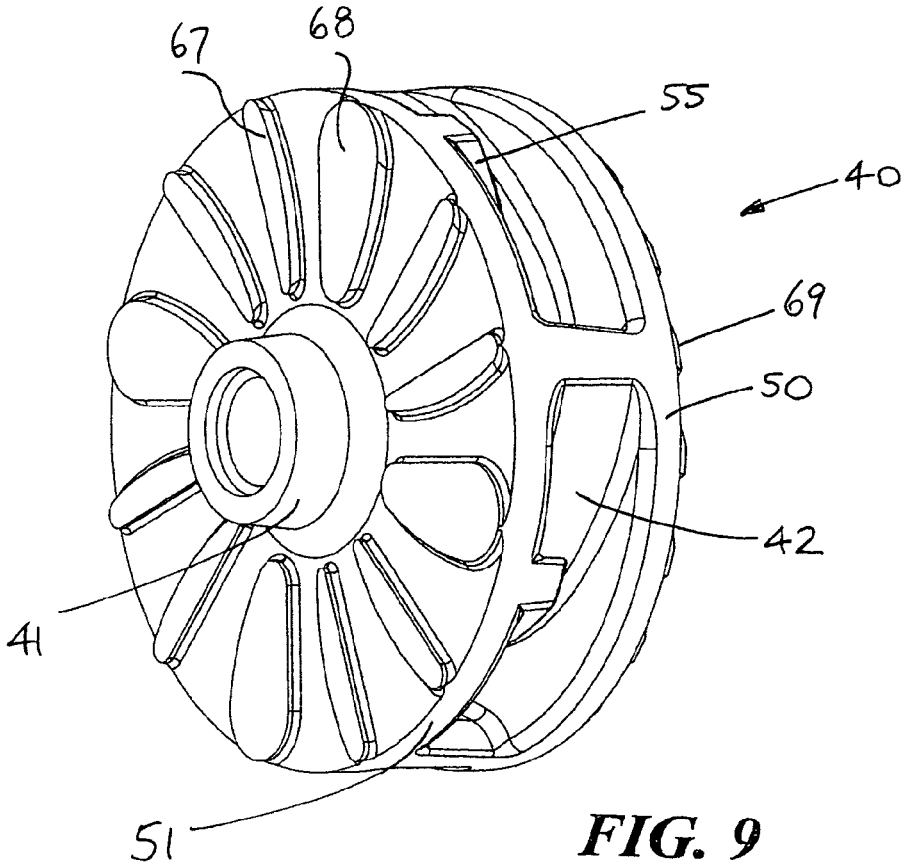
Figure 10:
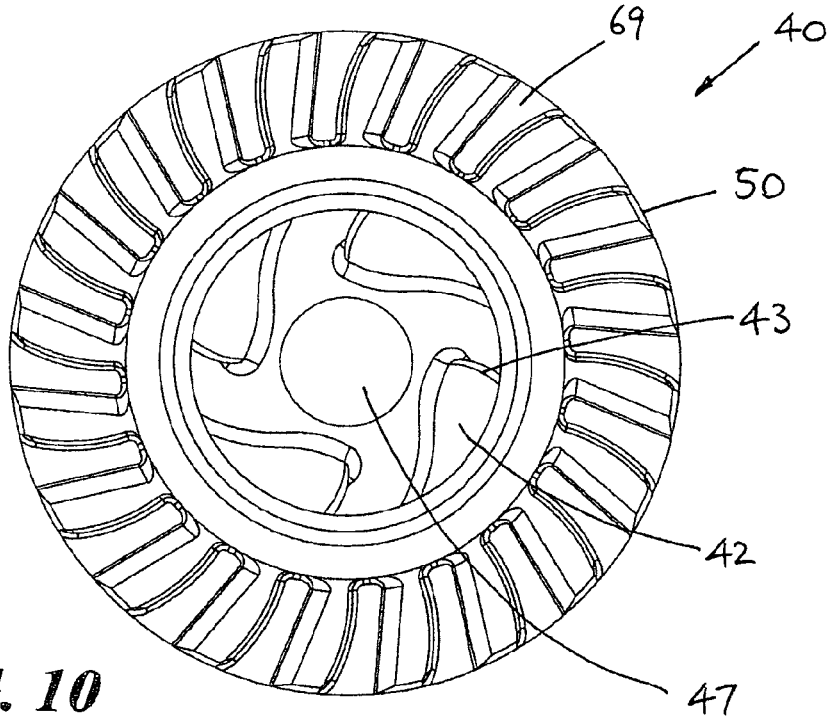
Figure 11:
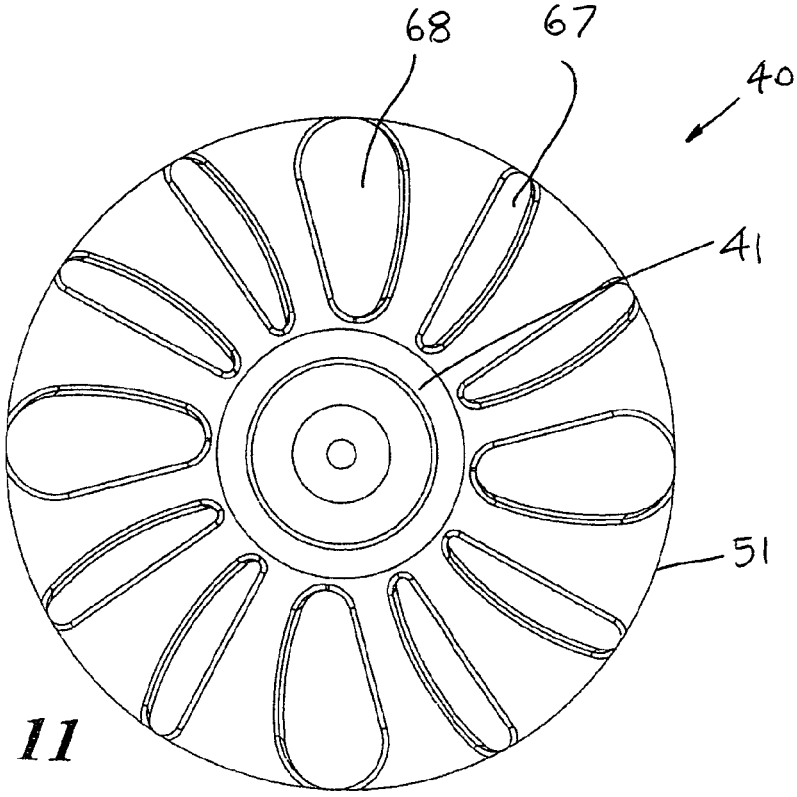
Figure 12:
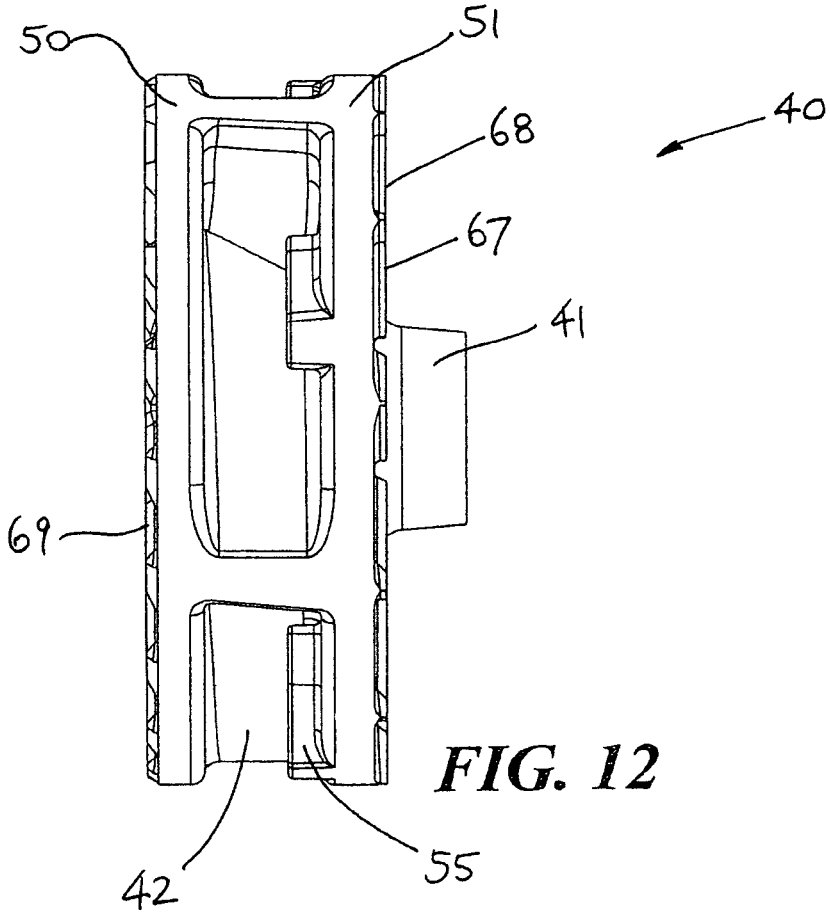

In the particular embodiment of a partial impeller 10A shown in FIG. 2, one exemplary pumping vane 42 only is shown which extends between the opposing main inner faces of the shrouds 50, 51. Normally such an impeller 10A has a plurality of such pumping vanes spaced evenly around the area between the said shrouds 50, 51, for example three, four or five pumping vanes are usual in slurry pumps. In this drawing only one pumping vane has been shown for convenience to illustrate the features. As shown in FIG. 2 the exemplary pumping vane 42 is generally arcuate in cross-section and includes an inner leading edge 43 and an outer trailing edge 44 and opposed side faces 45 and 46, the side face 45 being a pumping or pressure side. The vanes are normally referred to as backward-curving vanes when viewed with the direction of rotation. Reference numerals identifying the various features described above have only been indicated on the one vanes 42 shown, for the sake of clarity. The important major dimensions of $L_t$, $R_v$ and $T_v$ have been shown in the Figure and are defined below in this specification.

Figure 1A:
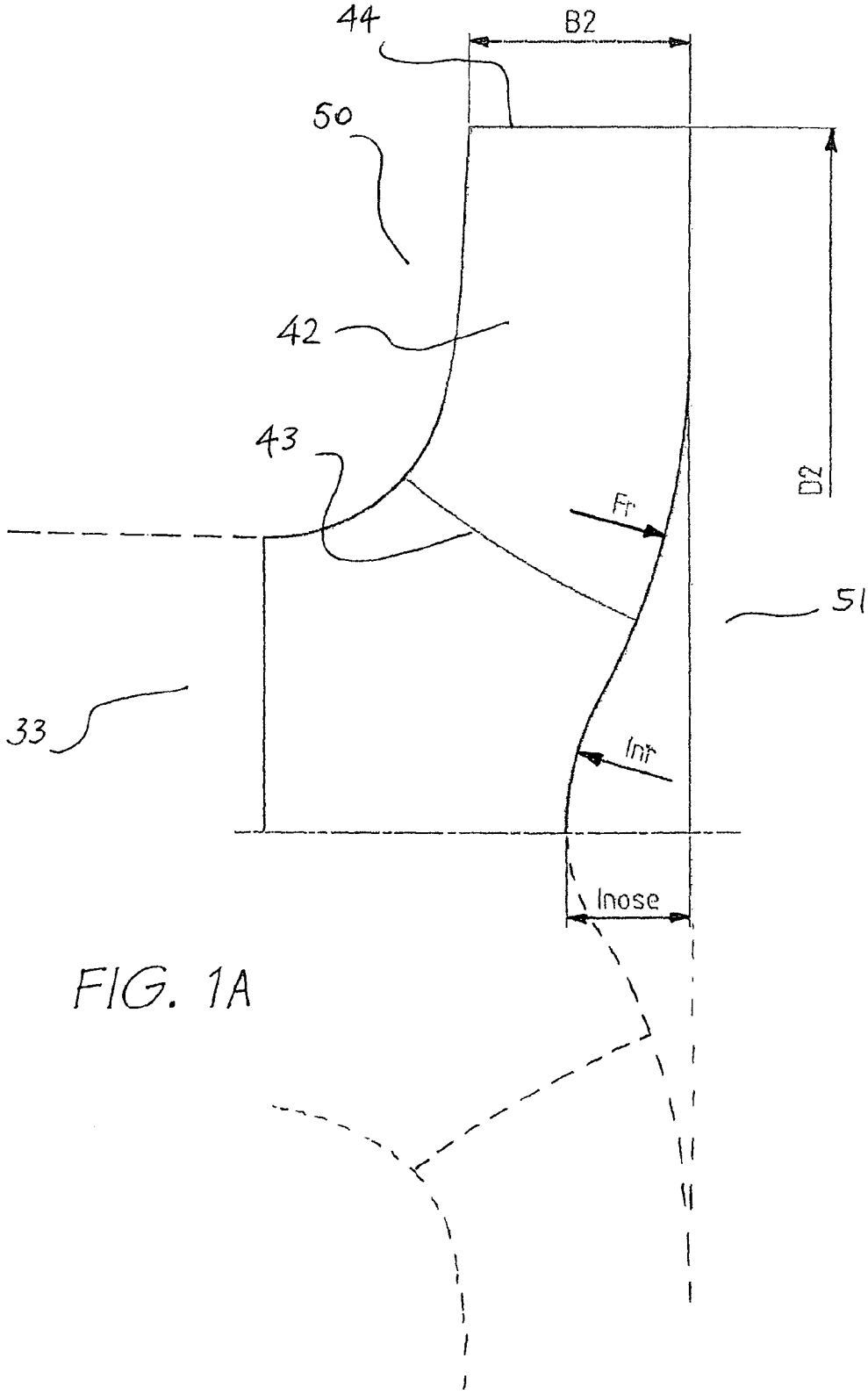
FIG. 1A illustrates a detailed view of a portion of the impeller of FIG. 1.

In accordance with certain embodiments, an exemplary impeller is illustrated in FIGS. 3 to 12. For convenience the same reference numerals have now been used to identify the same parts described with reference to FIGS. 1, 1A and 2. In the particular embodiment shown in FIGS. 3 to 12, the impeller 40 has a plurality of discharge guide vanes (or vanelets). The discharge guide vanes are in the form of elongate, flat-topped projections 55 which are generally sausage-shaped in cross-section. These projections 55, extend respectively from the main face of the back shroud 51 and are arranged in between two adjacent pumping vanes 42. The projections 55 have a respective outer end 58 which is located adjacent to the outer peripheral edge the shroud 51 on which they are disposed. The discharge guide vanes also have an inner end 60, which is located somewhere midway a respective passageway. The inner ends 60, of respective discharge guide vanes 55 are spaced some distance from the central rotational axis X-X of the impeller 40. Typically although not necessarily, the discharge guide vanes can be associated with each passageway.

Each discharge guide vane in the form of a projection 55 is shown in the drawings with a height of approximately 30-35% of the width of the pumping vane 42 where the width of the pumping vane is defined as the distance between the front and back shrouds of the impeller. In further embodiments the guide vane height can be between 5% to 50% of the said pumping vane 42 width. Each guide vane is of generally constant height along its length, although in other embodiments the guide vane can be tapered in height and also tapered in width. As is apparent from the drawings, the vanes have bevelled peripheral edges.

In the embodiment shown in FIGS. 3 to 12, each discharge guide vane can be located closer to the pumping or pressure side face of the closest adjacent pumping vane. The positioning of a discharge guide vane closer to one adjacent pumping vane can advantageously improve pump performance. Such embodiments are also disclosed in this Applicant's co-pending International patent application PCT/AU2009/000661 entitled "Slurry Pump Impeller" which was filed on the same day as the present application, the contents of which are included herein by way of cross-reference.

In still other embodiments, the discharge guide vanes can extend for a shorter or longer distance into the discharge passageway than is shown in the embodiments of FIGS. 3 to 12, depending on the fluid or slurry to be pumped.

In still other embodiments, there can be more than one discharge guide vane per shroud inner main face, or in some instances no discharge guide vane on one of the opposing inner main faces of any two shrouds which define a discharge passageway.

In still other embodiments, the discharge guide vanes can be of a different cross-sectional width to the main pumping vanes, and may not even necessarily be elongate, so long as the desired effect on the flow of slurry at the impeller discharge is achieved.

It is believed that the discharge guide vanes will reduce the potential for high-velocity vortex type flows to form at low flows. This reduces the potential for particles to wear into the front or rear shrouds thereby resulting in wear cavities in which vortex type flows could originate and develop. The guide vanes will also reduce the mixing of the split off flow regions at the immediate exit of the impeller into the already rotating flow pattern in the volute. It is felt that the discharge guide vanes will smooth and reduce the turbulence of the flow from the impeller into the pump casing or volute.

As shown in FIGS. 8 to 12, the impeller 10 further includes expeller, or auxiliary, vanes 67, 68, 69 on respective outer faces of the shrouds. Some of the vanes on the back shroud 67, 68 have different widths. As shown in the Figures, all vanes including the discharge guide vanes have bevelled edges.

FIGS. 1 and 2 of the drawings identify the following parameters:

| | |
|---|---|
| $D_1$ | Impeller inlet diameter at the intersection point of the front shroud and leading edge of the pumping vane |
| $D_2$ | Impeller outside diameter which is the outer diameter of the pumping vanes which in some exemplary embodiments is the same as the impeller back shroud. |
| $D_3$ | Front liner first end diameter |
| $D_4$ | Front liner second end diameter |
| $A_1$ | Angle between vane leading edge and impeller central rotation axis |
| $A_2$ | Angle between the parallel faces of impeller and front liner, and a plane normal to the rotation axis |
| $A_3$ | Angle of front liner raised lip away from the impeller central rotational axis |
| $R_s$ | Impeller front shroud radius of curvature at that point where the intake component or throat bush and the front shroud of the impeller are aligned (that is, where the flow leaves the throat bush and enters the impeller) |
| $R_v$ | Vane leading edge radius |
| $T_v$ | Vane thickness of pumping vane main portion |
| $L_t$ | Transition length of vane |
| $B_2$ | Impeller outlet width |
| $I_{nr}$ | Radius of curvature of the curved profile of the nose of the impeller at the hub |
| $I_{nose}$ | Distance from a plane containing the inner main face of the back shroud to the nose apex, at right angles to the central axis |
| $F_r$ | Radius of curvature of the transition region between the inner main face and the nose. |

Preferably one or more of these parameters have dimensional ratios in the following ranges:

$$D4 = 0.55D_3 \text{ to } 1.1D_3$$

$$D_1 = 0.25D_2 \text{ to } 0.75D_2 \text{ more preferably}$$
$$0.25D_2 \text{ to } 0.5D_2 \text{ more preferably}$$
$$0.40D_2 \text{ to } 0.75D_2.$$

$$R_s = 0.05D_2 \text{ to } 0.16D_2, \text{ more preferably}$$
$$0.08D_2 \text{ to } 0.15D_2, \text{ more preferably}$$
$$0.11D_2 \text{ to } 0.14D_2$$

$$R_v = 0.09T_v \text{ to } 0.45T_v, \text{ more preferably}$$
$$0.125T_v \text{ to } 0.31T_v, \text{ more preferably}$$
$$0.18T_v \text{ to } 0.19T_v$$

$$T_v = 0.03D_2 \text{ to } 0.11D_2 \text{ more preferably}$$
$$0.055D_2 \text{ to } 0.10D_2$$

$$B_2 = 0.08D_2 \text{ to } 0.2D_2$$

$$I_{nr} = 0.02D_2 \text{ to } 0.50D_2, \text{ more preferably}$$
$$= 0.10D_2 \text{ to } 0.33D_2, \text{ more preferably}$$
$$= 0.17D_2 \text{ to } 0.22D_2$$

-continued $$I_{nose} = 0.25B_2 \text{ to } 0.75B_2, \text{ more preferably}$$
$$= 0.40B_2 \text{ to } 0.65B_2 \text{ more preferably}$$
$$= 0.48B_2 \text{ to } 0.56B_2$$

$$Fr = 0.20D_2 \text{ to } 0.75D_2, \text{ more preferably}$$
$$= 0.32D_2 \text{ to } 0.65D_2, \text{ more preferably}$$
$$= 0.41D_2 \text{ to } 0.52D_2.$$

And have angles in the ranges:
$A_2$=0 to 20°
$A_3$=10° to 80°
$A_1$=20° to 35°

EXAMPLES

Comparative trials were conducted with a conventional pump and a pump according an exemplary embodiment. The various relevant dimensions of the two pumps are set out below.

| Conventional Pump Impeller | New Pump Impeller |
|---|---|
| $D_1$ = 203 mm | = 226 mm |
| $D_2$ = 511 mm | = 550 mm |
| $R_s$ = 156 mm | = 60 mm |
| $R_v$ = 2 mm | = 6 mm |
| $T_v$ = Varies (up to maximum of 76 mm) | = 32 mm |
| $L_t$ = None | = 67 mm |
| $B_2$ = 76 mm | = 72 mm |
| $F_r$ = 232 mm | = 228 mm |
| $I_{nr}$ = 95 mm | = 95 mm |
| $A_1$ = 0 (parallel to inlet axis) | = 25° |
| **Front Liner** | **Front Liner** |
| $A_2$ = 0 (perpendicular to inlet axis) | = ditto |
| $A_3$ = 60° | = 60° |
| $D_3$ = 203 mm | = 203 mm |
| $D_4$ = 200 mm | = 224 mm |

For the exemplary New Pump Impeller described herein above, the ratio $R_s/D_2$ is 0.109; the ratio $F_r/D_2$ is 0.415; the ratio $I_{nr}/D_2$ is 0.173 and the ration $R_v/T_v$ is 0.188.

Example 1

Both the new and conventional pumps were run at the same duty flow and speed on a gold mining ore. The conventional pump impeller life was 1,600 to 1,700 hours and front liner life 700 to 900 hours. The new design impeller and front liner life were both 2,138 hours.

Example 2

Both the new and conventional pumps were run at the same duty flow and speed on a gold mining ore which results in rapid wear due to the high silicon sand content of the slurry. Following three trials, the new impeller and front liner showed consistently 1.4 to 1.6 times more life than the conventional metal parts in the same material.

The conventional impeller typically failed by gross wear on the pump vanes and holing of the backshroud. The new impeller showed very little of this same type of wear.

Example 3

Both the new and conventional pumps were run at the same duty flow and speed in an alumina refinery in a duty which was critical to providing the proper feed to the plant. This duty was at high temperature and so favoured an impeller design with low cavitation characteristics.

The average life of the conventional impeller and front liner was 4,875 hours with some impeller wear, but typically the front liner failed by holing during use.

The new impeller and front liner life were in excess of 6,000 hours and without holing.

Example 4

Both the new and conventional pumps were run at the same duty flow and speed in an aluminia refinery where pipe and tank scaling can affect the production rate of the pump due to the effects of cavitation.

Based on the experiment, it has been calculated that the new impeller and front liner allowed an additional 12.5% increase in throughput while still remaining unaffected by cavitation.

Experimental Simulation

Computational experiments were carried out to define equations for the various designs of impeller disclosed herein, using commercial software. This software applies normalised linear regression or curve fitting methods to define a polynomial which describes the curvature of the inner faces of the impeller shrouds for certain embodiments disclosed herein.

Figure 13A:
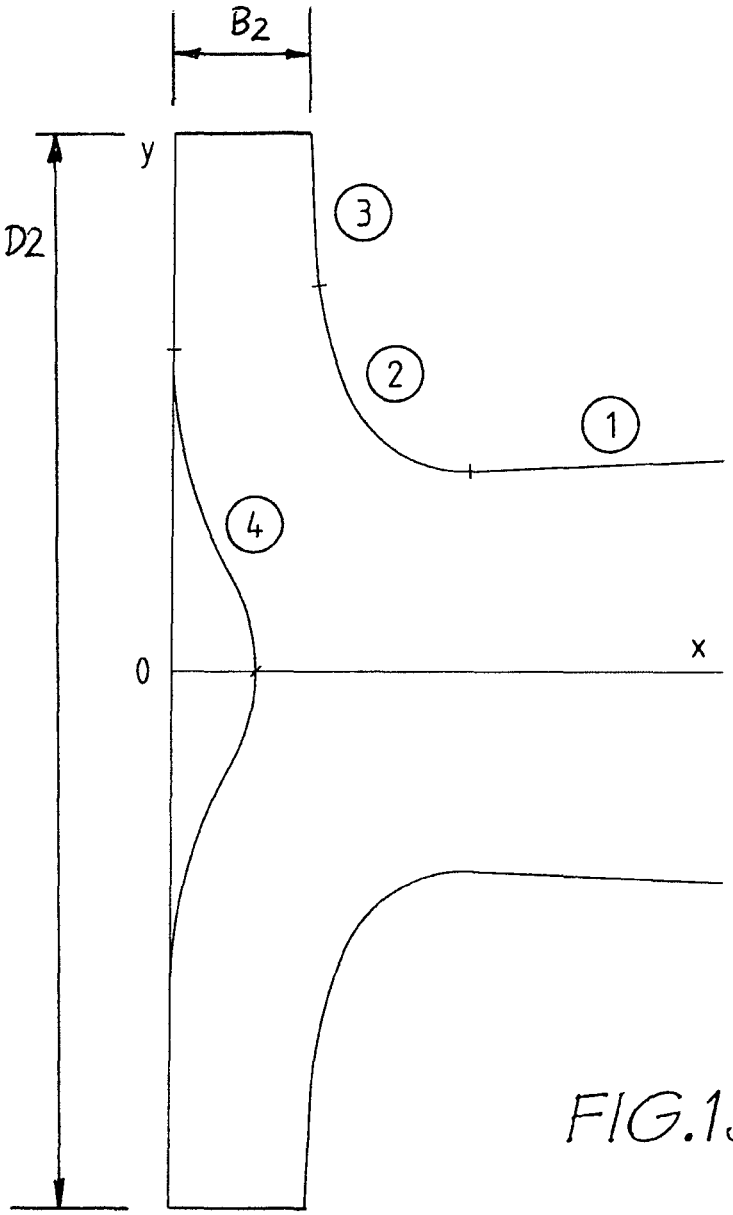
FIG. 13 A illustrates an exemplary, schematic, cross-sectional side elevation of an impeller and liner combination, in accordance with one embodiment showing the various regions of liner inlet (1), impeller front shroud (2), impeller front shroud outlet (3), and impeller back shroud nose (4)
FIG. 13B illustrates an exemplary, schematic, cross-sectional side elevation of an impeller and liner combination, in accordance with one embodiment wherein the data points are produced by curve fitting and linear regression modelling to show the internal profile of the various regions shown in FIG. 13 A.
Figure 13B:
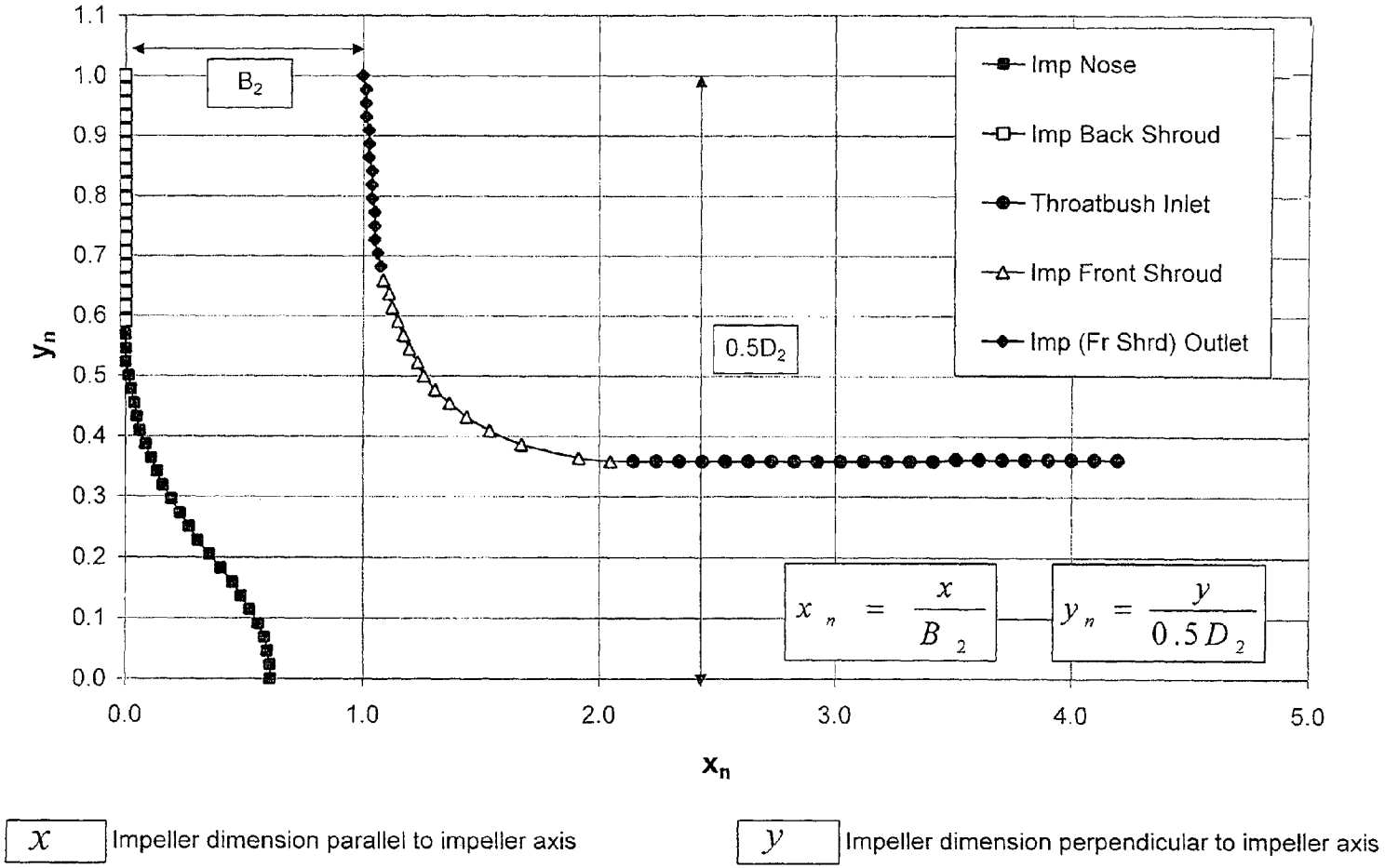

Each selected embodiment of an impeller when viewed in cross-section in a plane drawn through the rotational axis has four general profile regions which each have distinct features of shape, as illustrated in FIG. 13 A. FIG. 13B is the profile of the features of shape of a particular impeller which have been produced by use of the polynomial. Along the X-axis (which is a line which extends from the hub of the impeller through the centre of the impeller nose and coaxial with the rotational axis X-X), actual impeller dimensions are taken and divided by $B_2$ (the impeller outlet width) to produce a normalised value $X_n$. Along the Y-axis (which is a line which extends at right angles to the rotational axis X-X and in the plane of the main inner face of the back shroud), actual impeller dimensions are taken and divided by $0.5\times D_2$ (half of the impeller outside diameter) to produce a normalised value $Y_n$. The values of $X_n$ and $Y_n$ then regressed to calculate a polynomial to describe the profile of the region (2) which is the acuate inner face in the region of the impeller inlet, and the profile of the region (4) which is the curved profile of the impeller nose region.

In one embodiment where $D_2$ is 550 mm and $B_2$ is 72 mm, the profile region (2) is defined by:

$$y_n=-2.3890009903x_n^5+19.4786939775x_n^4-63.2754154980x_n^3+102.6199259524x_n^2-83.4315403428x+27.7322233171$$

In one embodiment where $D_2$ is 550 mm and $B_2$ is 72 mm, the profile region (4) is defined by:

$$y=-87.6924201323x_n^5+119.7707929717x_n^4-62.3921978066x_n^3+16.0543468684x_n^2-2.7669594052x+0.5250083657.$$

In one embodiment where $D_2$ is 1560 mm and $B_2$ is 190 mm, the profile region (2) is defined by:

$$y_n=-7.0660920862x_n^5+56.8379443295x_n^4-181.1145997000x_n^3+285.9370452104x_n^2-223.9802206897x+70.2463717260$$

In one embodiment where $D_2$ is 1560 mm and $B_2$ is 190 mm, the profile region (4) is defined by:

$$y_n=-52.6890959578x_n^5+79.4531495101x_n^4-45.7492175031x_n^3+13.0713205894x_n^2-2.5389732284x+0.5439201928.$$

In one embodiment where $D_2$ is 712 mm and $B_2$ is 82 mm, the profile region (2) is defined by:

$$y_n=-0.8710521204x_n^5+7.8018806610x_n^4-27.9106218350x_n^3+50.0122747105x_n^2-45.1312740213x+16.9014790579$$

In one embodiment where $D_2$ is 712 mm and $B_2$ is 82 mm, the profile region (4) is defined by:

$$y_n=-66.6742503139x_n^5+103.3169809752x_n^4-60.6233286019x_n^3+17.0989215719x_n^2-2.9560300900x+0.5424661895.$$

In one embodiment where $D_2$ is 776 mm and $B_2$ is 98 mm, the profile region (2) is defined by:

$$y_n=-0.2556639974x_n^5+2.6009971578x_n^4-10.5476726720x_n^3+21.4251116716x_n^2-21.9586498788x+9.5486465528$$

In one embodiment where $D_2$ is 776 mm and $B_2$ is 98 mm, the profile region (4) is defined by:

$$y_n=-74.2097253182x_n^5+115.5559502836x_n^4-67.8953477381x_n^3+19.1100516593x_n^2-3.2725057764x+0.5878323997.$$

In the foregoing description of certain exemplary embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "above" and "below" and the like are used as words of convenience to provide reference points and are not to be construed as limiting terms.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Finally, it is to be understood that various alterations, modifications and/or additions may be incorporated into the various constructions and arrangements of parts without departing from the spirit or ambit of the invention.

The invention claimed is:

1. An impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis, the impeller including a front shroud, a back shroud and a plurality of pumping vanes therebetween, each pumping vane having a leading edge in the region of an impeller inlet and a trailing edge, wherein the front shroud has an arcuate inner face in the region of the impeller inlet, the arcuate inner face having a radius of curvature ($R_s$) in the range from 0.05 to 0.16 of the outer diameter of the impeller ($D_2$), said back shroud including an inner main face and a nose having a curved profile with a nose apex in the region of the central axis which extends towards the front shroud, there being a curved transition region between the inner main face and the nose, wherein $F_r$ is the radius of curvature of the transition region, the ratio $F_r/D_2$ being from 0.32 to 0.65.

2. An impeller as claimed in claim 1, wherein the inner face has a radius of curvature $R_S$ in the range from 0.08 to 0.15 of the outer diameter $D_2$ of the impeller.

3. An impeller according to claim 1 wherein $I_{nose}$ is the distance from a plane containing the inner main face of the back shroud to the nose apex at right angles to the central axis, and $B_2$ is the pumping vane width, and the ratio $I_{nose}/B_2$ being from 0.25 to 0.75.

4. An impeller according to claim 1 wherein each pumping vane has a main portion extending between the leading edge and trailing edge portions thereon, the pumping vane leading edge portion tapered transition length and a leading edge having a radius $R_V$ in the range from 0.09 to 0.45 of the thickness $T_V$ of a main vane portion.

5. An impeller according to claim 4, wherein the pumping vane thickness Tv of the main portion of the pumping vanes is in the range from 0.03 to 0.11 of the outer diameter $D_2$ of the impeller.

6. An impeller according to claim 1 wherein each pumping vane has a main portion having a thickness $T_v$ and each pumping vane has a leading edge having a radius $R_v$ in the range from 0.09 to 0.45 of the main portion thickness $T_v$.

7. An impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis, the impeller including a front shroud, a back shroud and a plurality of pumping vanes therebetween, each pumping vane having a leading edge in the region of an impeller inlet and a trailing edge, wherein the front shroud has an arcuate inner face in the region of the impeller inlet, the arcuate inner face having a radius of curvature ($R_s$) in the range from 0.05 to 0.16 of the outer diameter of the impeller ($D_2$), said back shroud having an inner main face and a nose having a curved profile with a nose apex in the region of the central axis which extends towards the front shroud, there being a curved transition region between the inner main face and the nose, wherein $I_{nr}$ is the radius of curvature of the curved profile of the nose, the ratio $I_{nr}/D_2$ being from 0.17 to 0.22.

8. An impeller according to claim 7, wherein each pumping vane has a main portion extending between the leading edge and trailing edge portions thereon, the pumping vane leading edge portion tapered transition length and a leading edge having a radius Rv in the range from 0.09 to 0.45 of the thickness Tv of the main vane portion.

9. An impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis, the impeller including a front shroud, a back shroud and a plurality of pumping vanes therebetween with passageways between adjacent pumping vanes, each pumping vane having a leading edge in the region of an impeller inlet and a trailing edge, wherein the front shroud has an arcuate inner face in the region of the impeller inlet, the inner face having a radius of curvature (Rs) in the range from 0.05 to 0.16 of the outer diameter of the impeller ($D_2$) and wherein one or more of the passageways have one or more discharge guide vanes associated therewith, each discharge guide vane being located at a main face of at least one of the shrouds.

10. An impeller as claimed in claim 9, wherein the inner face has a radius of curvature $R_s$ in the range from 0.08 to 0.15 of the outer diameter $D_2$ of the impeller.

11. An impeller according to claim 9, wherein each pumping vane has a main portion extending between the leading edge and trailing edge portions thereon, the pumping vane leading edge portion tapered transition length and a leading edge having a radius Rv in the range from 0.09 to 0.45 of the thickness Tv of the main vane portion.

12. An impeller for use in a centrifugal pump, the pump including a pump casing having a chamber therein, an inlet for delivering material to be pumped to the chamber and an outlet for discharging material from the chamber, the impeller being mounted for rotation within the chamber when in use about a rotation axis, the impeller including a front shroud, a back shroud and a plurality of pumping vanes therebetween, each pumping vane having a leading edge in the region of an impeller inlet and a trailing edge with a main portion therebetween, wherein each pumping vane has a vane leading edge having a radius $R_v$ in the range from 0.18 to 0.19 of the thickness $T_v$ of the main portion of the pumping vane.

13. An impeller according to claim 12, wherein the pumping vane thickness Tv of the main portion of the pumping vanes is in the range from 0.03 to 0.11 of the outer diameter $D_2$ of the impeller.

14. An impeller according to claim 12, wherein each pumping vane has a transition length $L_t$ between the leading edge and the full vane thickness $T_v$, the transition length being in the range from 0.5 $T_v$ to 3 $T_v$.

15. An impeller according to claim 12 wherein the thickness of the main portion is substantially constant throughout its length.

16. An impeller according to claim 12, wherein the main portion thickness $T_v$ of each vane is in the range from 0.03 to 0.11 of the outer diameter $D_2$ of the impeller.

17. An impeller according to claim 12, further comprising passageways positioned between adjacent pump vanes, and wherein one or more of the passageways have one or more discharge guide vanes positioned therein, each discharge guide vane being located at the main face of at least one of the back shroud or front shroud.

18. An impeller according to claim 12 wherein each said discharge guide vane has a height which is from 5 to 50 percent of pumping vane width.

19. An impeller according to claim 12, wherein each pumping vane leading edge is positioned at an angle $A_1$ to the impeller central axis, the angle $A_1$ being from 20° to 35°.

20. An impeller according to claim 12, wherein the impeller is formed with an impeller inlet having a diameter $D_1$ that is in the range from 0.25 to 0.75 of an impeller outer diameter $D_2$.

21. An impeller according to claim 12, further comprising a front liner, the front liner having a raised lip which subtends an angle ($A_3$) to the impeller central axis in the range from 10° to 80°.

22. An impeller according to claim 12, wherein the front shroud has an arcuate inner face in the region of the impeller inlet, the arcuate inner face having a radius of curvature ($R_s$) in the range from 0.05 to 0.16 of the outer diameter of the impeller ($D_2$), said back shroud including an inner main face and a nose having a curved profile with a nose apex in the region of the central axis which extends towards the front shroud, there being a curved transition region between the inner main face and the nose, wherein $F_r$ is the radius of curvature of the transition region, the ratio $F_r/D_2$ being from 0.32 to 0.65.

23. An impeller according to claim 22 wherein $I_{nr}$ is the radius of curvature of the curved profile of the nose, the ratio $I_{nr}/D_2$ being from 0.10 to 0.33.

24. An impeller which includes a front shroud and a back shroud, the back shroud including a back face and an inner main face with an outer peripheral edge and a central axis, a plurality of pumping vanes projecting from the inner main face of the back shroud to the front shroud, the pumping vanes being disposed in spaced apart relation on the inner main face providing a discharge passageway between adjacent pumping vanes, each pumping vane including a leading edge portion in the region of the central axis and a trailing edge portion in the region of the peripheral edge, the back shroud further including a nose having a curved profile with a nose apex in the region of the central axis which extends towards the front shroud, there being a curved transition region between the inner main face and the nose, wherein $F_r$ is the radius of curvature of the transition region and $D_2$ is the diameter of the impeller, and the ratio $F_r/D_2$ being from 0.20 to 0.75, wherein one or more of the passageways have associated therewith one or more discharge guide vanes, each discharge guide vane being located at a main face of at least one of the front shroud or back shroud.

* * * * *